US009175372B2

(12) United States Patent
Hori et al.

(10) Patent No.: US 9,175,372 B2
(45) Date of Patent: Nov. 3, 2015

(54) ALUMINUM ALLOY FORGED MATERIAL FOR AUTOMOBILE AND METHOD FOR MANUFACTURING THE SAME

(71) Applicant: Kobe Steel, Ltd., Kobe-shi (JP)

(72) Inventors: Masayuki Hori, Inabe (JP); Yoshiya Inagaki, Inabe (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

(21) Appl. No.: 13/800,263

(22) Filed: Mar. 13, 2013

(65) Prior Publication Data

US 2013/0255841 A1 Oct. 3, 2013

(30) Foreign Application Priority Data

Mar. 30, 2012 (JP) ..... 2012-080999
Dec. 5, 2012 (JP) ..... 2012-266696

(51) Int. Cl.
*C22F 1/047* (2006.01)
*C22F 1/043* (2006.01)
(Continued)

(52) U.S. Cl.
CPC ..... *C22F 1/047* (2013.01); *B21C 23/002* (2013.01); *B21K 1/12* (2013.01); *B21K 1/74* (2013.01); *B21K 7/00* (2013.01); *C22C 21/00* (2013.01); *C22C 21/02* (2013.01); *C22C 21/06* (2013.01); *C22C 21/08* (2013.01); *C22F 1/043* (2013.01); *C22F 1/05* (2013.01)

(58) Field of Classification Search
USPC ..... 148/417, 550, 552
See application file for complete search history.

(56) References Cited

U.S. PATENT DOCUMENTS 6,678,574 B2 1/2004 Fujii et al.
8,152,940 B2 4/2012 Nakai et al.
(Continued)

FOREIGN PATENT DOCUMENTS

JP 2001-107168 4/2001

OTHER PUBLICATIONS

The Extended European Search Report issued Nov. 28, 2013, in Application No. / Patent No. 13001594.4-1362 / 2644725.
(Continued)

*Primary Examiner* — Kaj K Olsen
*Assistant Examiner* — Alexander Polyansky
(74) *Attorney, Agent, or Firm* — Oblon, McClelland, Maier & Neustadt, L.L.P.

(57) ABSTRACT

It is an object to provide an aluminum alloy forged material for an automobile excellent in tensile strength while maintaining excellent corrosion resistance, and a method for manufacturing the same. Provided are the aluminum alloy forged material for an automobile and a method for manufacturing the same, the aluminum alloy forged material being composed of an aluminum alloy including Si: 0.7-1.5 mass %, Fe: 0.1-0.5 mass %, Mg: 0.6-1.2 mass %, Ti: 0.01-0.1 mass % and Mn: 0.3-1.0 mass %, further including at least one element selected from Cr: 0.1-0.4 mass % and Zr: 0.01-0.2 mass %, restricting Cu: 0.1 mass % or less and Zn: 0.05 mass % or less, and a hydrogen amount: 0.25 ml/100 g-Al or less, the remainder being Al and unavoidable impurities, in which the depth of recrystallization from the surface is 5 mm or less.

7 Claims, 6 Drawing Sheets

(51) Int. Cl.

| | |
|---|---|
| ***C22C 21/02*** | (2006.01) |
| ***C22C 21/06*** | (2006.01) |
| ***C22C 21/08*** | (2006.01) |
| ***C22C 21/00*** | (2006.01) |
| ***C22F 1/05*** | (2006.01) |
| ***B21K 1/12*** | (2006.01) |
| ***B21K 1/74*** | (2006.01) |
| ***B21C 23/00*** | (2006.01) |
| ***B21K 7/00*** | (2006.01) |

(56) References Cited

U.S. PATENT DOCUMENTS

| | | | |
|---|---|---|---|
| 8,372,220 | B2 | 2/2013 | Inagaki et al. |
| 2010/0089503 | A1 | 4/2010 | Inagaki et al. |
| 2011/0221151 | A1 | 9/2011 | Sakamoto et al. |
| 2013/0032255 | A1 | 2/2013 | Hori et al. |

OTHER PUBLICATIONS

U.S. Appl. No. 13/841,377, filed Mar. 15, 2013, Hori, et al.
U.S. Appl. No. 14/191,782, filed Feb. 27, 2014, Hori et al.

ALUMINUM ALLOY FORGED MATERIAL FOR AUTOMOBILE AND METHOD FOR MANUFACTURING THE SAME

BACKGROUND OF THE INVENTION

1. Field of the Invention

The present invention relates to an aluminum alloy forged material suitably used for a chassis member, structural member and the like for an automobile, and a method for manufacturing the same.

2. Description of the Related Art

Conventionally, for structural materials of transportation vehicles such as railway vehicles, marine vessels, aircrafts, motorcycles or automobiles and the like, aluminum alloys such as a 6000 series (Al—Mg—Si-based) and the like stipulated in JIS standards or AA standards (may be hereinafter abbreviatingly expressed as an "Al alloy") have been used. This 6000 series aluminum alloy is comparatively excellent in corrosion resistance also, and is excellent also in recycling performance allowing scraps thereof to be reused as melting raw material for the 6000 series aluminum alloy.

Also, for the structural materials of vehicles for transportation, from the viewpoints of lowering the manufacturing cost and working into components of a complicated shape, aluminum alloy cast materials and aluminum alloy forged materials have been used. Out of them, for strength members in which the mechanical properties such as high strength, high toughness and the like are required, that is the chassis members for an automobile such as an upper arm, lower arm and the like for example, the aluminum alloy forged materials have been mainly used.

These aluminum alloy forged materials are manufactured by subjecting the aluminum alloy cast materials to homogenizing heat treatment, thereafter to hot forging such as mechanical forging, oil hydraulic forging and the like, and thereafter to refining treatment such as solution heat treatment, quenching treatment, artificial aging treatment (may be hereinafter simply referred to also as aging treatment) and the like. Also, in order to forge an aluminum alloy, extruded materials obtained by subjecting the cast materials to homogenizing heat treatment and thereafter to extrusion working may be used.

In recent years, in the strength members of these transportation vehicles, because of increasing requirements of low fuel consumption and low $CO_2$ emission, requirements of further weight reduction (thinning) have been raised. Although 6000 series aluminum alloy forged materials such as 6061, 6151 and the like have been used for these applications so far, their performances are insufficient in strength and toughness.

In order to solve such problem, as described in JP-A No. 2001-107168, the present inventors proposed before a high strength and high toughness aluminum alloy forged material excellent in corrosion resistance including Mg: 0.6-1.8% (mass %, hereinafter the same), Si: 0.6-1.8%, further including one or two elements of Cr: 0.1-0.2% and Zr: 0.1-0.2%, restricting Cu: 0.25% or less, Mn: 0.05% or less, Fe: 0.30% or less, hydrogen: 0.25 cc/100 g-Al or less respectively, the remainder being Al and unavoidable impurities, in which the average grain size of $Mg_2Si$ and Al—Fe—Si—(Mn, Cr, Zr)-based crystallized and precipitated products present on the grain boundary of the aluminum alloy structure was made 1.2 μm or less, and the average interval between these crystallized and precipitated products was made 3.0 μm or more.

However, although it was clarified that the aluminum alloy forged material described in JP-A No. 2001-107168 was excellent in corrosion resistance, the transition elements represented by Mn, Cr, Zr were less, therefore the crystal grains were liable to be coarsened by recrystallization, and variation in tensile strength became extremely large. When application to chassis components of an automobile is assumed particularly, highly reliable tensile strength is required. Accordingly, when the variation in tensile strength was large, the tensile strength used in designing lowered, and development in such use became hard which became a problem.

SUMMARY OF THE INVENTION

The present invention has been developed in view of such circumstance, and its object is to provide an aluminum alloy forged material for an automobile excellent in tensile strength while maintaining excellent corrosion resistance, and a method for manufacturing the same.

Therefore, the present inventors carried out investigations on the cause of the variation in tensile strength. As a result, it was found out that, in executing the tensile test of the aluminum alloy forged material, the start point of a crack in breakage basically started from the vicinity of the surface and was not directly related to the thickness of the member, that the recrystallized structure in the vicinity of the surface of the forged material was low in strength and therefore was liable to cause a crack, and that the depth of the recrystallized structure in the vicinity of the surface was related to easiness of occurrence of the crack. Also, it was found out that, by making the depth of the recrystallized structure from the surface of the aluminum alloy forged material a specific value or less, variation in tensile strength reduced by far which led to improvement of the tensile strength.

Further, in order to make such the depth of the recrystallized structure from the surface of the aluminum alloy forged material a specific value or less, investigations on the composition of elements composing the aluminum alloy and the manufacturing condition were carried out which resulted in finding out that the tensile strength could be improved with good reproducibility by manufacturing in a specific manufacturing condition with a specific alloy composition, which led to the present invention.

In order to solve the problems, the aluminum alloy forged material for an automobile of an embodiment of the present invention is an aluminum alloy forged material composed of an aluminum alloy including Si: 0.7-1.5 mass %, Fe: 0.1-0.5 mass %, Mg: 0.6-1.2 mass %, Ti: 0.01-0.1 mass % and Mn: 0.3-1.0 mass %, further including at least one element selected from Cr: 0.1-0.4 mass % and Zr: 0.01-0.2 mass %, restricting Cu: 0.1 mass % or less and Zn: 0.05 mass % or less, and a hydrogen amount: 0.25 ml/100 g-Al or less, the remainder being Al and unavoidable impurities, in which the depth of recrystallization from the surface is 5 mm or less.

Also, the aluminum alloy forged material for an automobile is preferable to be an aluminum alloy forged material composed of an aluminum alloy including Si: 1.0-1.3 mass %, Fe: 0.2-0.4 mass %, Mg: 0.7-1.1 mass %, Ti: 0.01-0.08 mass % and Mn: 0.5-0.9 mass %, further including at least one element selected from Cr: 0.1-0.3 mass % and Zr: 0.05-0.2 mass %, restricting Cu: 0.1 mass % or less and Zn: 0.05 mass % or less, and a hydrogen amount: 0.25 ml/100 g-Al or less, the remainder being Al and unavoidable impurities, in which the depth of recrystallization from the surface is 5 mm or less.

According to the constitution, the precipitated amount of $Mg_2Si$ is increased by containing Si and Mg by a predetermined amount, particularly by containing Si by a comparatively large amount, and the transition element particularly Mn is contained by a comparatively large amount, thereby the crystal structure of the forged material is miniaturized, the depth of the recrystallized structure is reduced, and the tensile strength is improved.

Also, by restricting the Cu content to a specific figure or less and by positively containing the transition elements to miniaturize the crystal structure of the forged material, intergranular corrosion sensitivity becomes dull, and the corrosion resistance can be retained. Further, by making the Fe content comparatively less amount and making the hydrogen amount a predetermined amount or less, drop of the toughness and fatigue properties is suppressed.

By employing the aluminum alloy forged material using an aluminum alloy having such the composition and controlling the depth of recrystallization from the surface to 5 mm or less, the tensile strength as a forged material can be improved while maintaining excellent corrosion resistance. Also, by controlling the depth of recrystallization from the surface to less than 1 mm, the tensile strength as a forged material can be further improved while maintaining excellent corrosion resistance.

Also, the method for manufacturing the aluminum alloy forged material for an automobile in relation with an embodiment of the present invention includes a casting step of casting an ingot of the aluminum alloy at 700-780° C. of the heating temperature and 200-400 mm/min of the casting rate, a homogenizing heat treatment step of subjecting the ingot to temperature-raising at a rate of 0.5° C./min or more and less than 10° C./min, to homogenizing heat treatment at 480-560° C. for 2-12 hours, and to cooling to 300° C. or below at a rate of 1.0° C./min or more, a heating step of subjecting the ingot having been subjected to the homogenizing heat treatment to heating at 500-560° C. for 0.75-6 hours, a forging step of subjecting the ingot having been heated to forging at 450-560° C. of the forging start temperature and 360° C. or above of the forging finish temperature to obtain a forged material of a predetermined shape, a solution heat treatment step of subjecting the forged material to solution heat treatment at 500-560° C. for more than 0 hour and 24 hours or less, a quenching step of subjecting the forged material having been subjected to the solution heat treatment to quenching at 75° C. or below, and an artificial aging treatment step of subjecting the forged material having been quenched to artificial aging treatment at 140-200° C. for 1-24 hours.

Further, as the method for manufacturing the aluminum alloy forged material for an automobile in relation with an embodiment of the present invention, it is possible that a pre-form step of subjecting the ingot to pre-form shaping is executed after the heating step and the forging step is executed thereafter. Furthermore, it is also possible that an extrusion working step of subjecting the ingot to extrusion working is executed after the homogenizing heat treatment step and the heating step is executed thereafter.

Particularly, in the procedure described above, by strictly controlling conditions in plural steps such as to arrange the heating step of executing heating at 500-560° C. for 0.75-6 hours after the homogenizing heat treatment step, to control the heat treatment temperature and the cooling rate of the homogenizing heat treatment step to a predetermined range, to control the starting temperature and finishing temperature of the forging step to a predetermined range, to employ a predetermined condition as the temperature and the time of the solution heat treatment step, and the like, the depth of recrystallization from the surface of the aluminum alloy forged material which is a final product can be controlled to 5 mm or less.

The aluminum alloy forged material for an automobile in relation with the present invention has less variation in tensile strength, and is excellent in stress corrosion cracking resistance, tensile strength, 0.2% proof stress, and elongation. Also, according to the method for manufacturing in relation with the present invention, the aluminum alloy forged material for an automobile excellent in tensile strength while maintaining the corrosion resistance can be manufactured.

DESCRIPTION OF THE PREFERRED EMBODIMENTS

Figure 1:
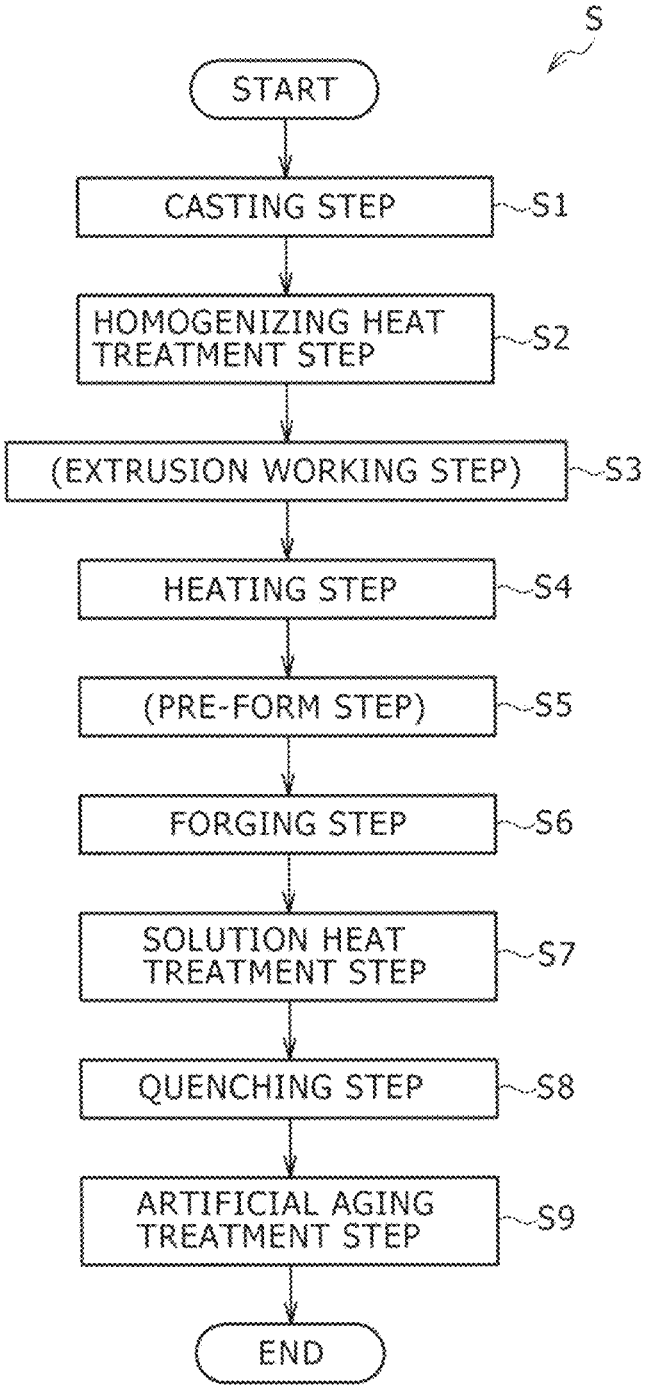
FIG. 1 is a flowchart showing the step of the method for manufacturing the aluminum alloy forged material for an automobile in relation with the present invention.

Below, the aluminum alloy forged material for an automobile and the method for manufacturing the same in relation with the present invention will be described in detail. First, the aluminum alloy in relation with the present invention will be described.

The aluminum alloy in relation with the present invention is an aluminum alloy including Si: 0.7-1.5 mass %, Fe: 0.1-0.5 mass %, Mg: 0.6-1.2 mass %, Ti: 0.01-0.1 mass % and Mn: 0.3-1.0 mass %, further including at least one element selected from Cr: 0.1-0.4 mass % and Zr: 0.01-0.2 mass %, restricting Cu: 0.1 mass % or less and Zn: 0.05 mass % or less, and a hydrogen amount: 0.25 ml/100 g-Al or less, the remainder being Al and unavoidable impurities.

The content of each element constituting the aluminum alloy in relation with the present invention will be described below.

(Si: 0.7-1.5 Mass %)

Si is an essential element for precipitating as $Mg_2Si$ (β' phase) along with Mg by artificial aging treatment, and imparting high strength (proof stress) when the aluminum alloy forged material which is the final product is used. When the Si content is less than 0.7 mass %, sufficient strength cannot be secured by artificial aging. On the other hand, when the Si content exceeds 1.5 mass %, coarse single body Si particles are crystallized and precipitated in casting and in the middle of quenching after the solution heat treatment, and deteriorate the corrosion resistance and toughness. Also, when Si increases excessively, the average grain size of $Mg_2Si$ and Al—Fe—Si—(Mn, Cr, Zr)-based crystallized and precipitated products present on the grain boundary does not become small, and the average interval between these crystallized and precipitated products cannot be increased.

As a result, similarly to the case of Mg described below, Si deteriorates the corrosion resistance and toughness of the aluminum alloy forged material. Further, workability is also impeded such as lowering of elongation of the aluminum alloy forged material. As an indication, it is preferable that the average grain size of $Mg_2Si$ and Al—Fe—Si—(Mn, Cr)-based crystallized and precipitated products is 1.2 μm or less, and that the average interval between the crystallized and precipitated products is 3.0 μm or more. Here, the knowledge on the average grain size and the average interval of the Al—Fe—Si—(Mn, Cr)-based crystallized and precipitated products is described in the gazette of JP-A 2001-107168 in relation with the application by the present applicant. The Si content is preferably in the range of 0.9-1.4 mass %, more preferably in the range of 1.0-1.3 mass %.

(Fe: 0.1-0.5 Mass %)

Fe forms Al—Fe—Si—(Mn, Cr)-based crystallized and precipitated products such as $Al_7Cu_2Fe$, $Al_{12}(Fe, Mn)_3Cu_2$, $(Fe, Mn)Al_6$ and the like. As described above, these crystallized and precipitated products deteriorate the fracture toughness, fatigue properties and the like. Particularly, when the Fe content exceeds 0.5 mass %, more strictly 0.3 mass %, it becomes hard to make the total area ratio of the Al—Fe—Si—(Mn, Cr)-based crystallized and precipitated products 1.5% or less, preferably 1.0% or less per unit area, and the aluminum alloy forged material having higher strength and higher toughness required for structural materials of transportation vehicles and the like cannot be secured. Here, the knowledge on the area ratio of the Al—Fe—Si—(Mn, Cr)-based crystallized and precipitated products is described in the gazette of JP-A 2008-163445 in relation with the application by the present applicant. The Fe content is preferably in the range of 0.2-0.4 mass %, more preferably in the range of 0.2-0.3 mass %.

(Mg: 0.6-1.2 Mass %)

Mg is an essential element for precipitating as $Mg_2Si$ (β' phase) along with Si by artificial aging treatment, and imparting high strength (0.2% proof stress) when the aluminum alloy forged material which is the final product is used. When the Mg content is less than 0.6 mass %, the age hardening amount reduces. On the other hand, when the Mg content exceeds 1.2 mass %, the strength (0.2% proof stress) increases excessively and forgeablity of the ingot is impeded. Also, a large amount of $Mg_2Si$ is liable to precipitate in the middle of quenching after the solution heat treatment, the average grain size of $Mg_2Si$ and Al—Fe—Si—(Mn, Cr)-based crystallized and precipitated products present on the grain boundary does not become small, and the average interval between these crystallized and precipitated products cannot be increased. As an indication, it is preferable that the average grain size of $Mg_2Si$ and Al—Fe—Si—(Mn, Cr)-based crystallized and precipitated products is 1.2 μm or less, and that the average interval between the crystallized and precipitated products is 3.0 μm or more. The Mg content is preferably in the range of 0.7-1.1 mass %, more preferably in the range of 0.8-1.0 mass %.

(Ti: 0.01-0.1 Mass %)

Ti is an element added in order to miniaturize the crystal grains of the ingot and to improve the workability in extrusion, rolling and forging. However, when the Ti content is less than 0.01 mass %, the effect of improving the workability cannot be secured because miniaturization of the crystal grains is insufficient, whereas when the Ti content exceeds 0.1 mass %, coarse crystallized and precipitated products are formed and the workability is liable to deteriorate. The Ti content is preferably in the range of 0.01-0.08 mass %, more preferably in the range of 0.02-0.05 mass %.

(Mn: 0.3-1.0 Mass %)

(At Least One Element Selected from Cr: 0.1-0.4 Mass % and Zr: 0.01-0.2 Mass %)

These elements form dispersed particles (dispersed phase) of $Al_6Mn$, $Sl_{12}Mg_2Cr$, an intermetallic compound of Al—Cr-based, Al—Zr-based and the like at the time of the homogenizing heat treatment and at the time of hot forging thereafter. Because these dispersed particles have the effect of impeding grain boundary movement after recrystallization, fine crystal grains and crystal sub-grains can be obtained. Therefore, among these elements, the Mn content should be 0.3-1.0 mass %. With respect to the content of Cr and Zr, at least either of Cr: 0.1-0.4 mass % and Zr: 0.01-0.2 mass % should be satisfied.

However, in all cases of including Cr or Zr, or including Cr and Zr, Cr and Zr should not exceed respective upper limits of 0.4 mass % and 0.2 mass %.

In these elements, when the content thereof is excessively low, the effect thereof cannot be expected, whereas when the content is excessively high, coarse Al—Fe—Si—(Mn, Cr)-based intermetallic compounds and crystallized and precipitated products are liable to be formed in melting and casting which become the start points of fracture and become a cause of deteriorating the toughness and fatigue properties. In such a case, total area ratio of the Al—Fe—Si—(Mn, Cr)-based crystallized and precipitated products cannot be made 1.5% or less, preferably 1.0% or less, per unit area, and high toughness and high fatigue properties cannot be secured.

The Mn content is preferably in the range of 0.5-0.9 mass %, more preferably in the range of 0.6-0.8 mass %.

The Cr content is preferably in the range of 0.1-0.3 mass %, more preferably in the range of 0.2-0.3 mass %.

The Zr content is preferably in the range of 0.05-0.2 mass %, more preferably in the range of 0.1-0.2 mass %.

(Cu: 0.1 Mass % or Less)

Cu extremely increases the sensitivity of stress corrosion crack and intergranular corrosion of the structure of the aluminum alloy forged material, and deteriorates the corrosion resistance and durability of the aluminum alloy forged material. From this viewpoint, in the present invention, the Cu content is restricted to be as little as possible. However, in actual operation, mixing in by approximately 0.1 mass % is unavoidable and its influence is slight, and therefore the Cu content is restricted to 0.1 mass % or less.

(Zn: 0.05 Mass % or Less)

When $MgZn_2$ can be precipitated finely and with high density at the time of artificial aging treatment by presence of Zn, high tensile strength can be achieved. However, because Zn largely lowers the corrosion potential of the product, the corrosion resistance is deteriorated. Also, because Zn combines with Mg and precipitates, the precipitation amount of $Mg_2Si$ is reduced which results in drop of the tensile strength. Therefore, the Zn content should be restricted to 0.05 mass % or less.

(Hydrogen: 0.25 ml/100 g-Al or Less)

Hydrogen ($H_2$) is liable to cause forging defect such as blow holes and the like caused by hydrogen, becomes the start point of fracture, and therefore is liable to deteriorate the toughness and fatigue properties particularly when the draft of the aluminum alloy forged material is low. Especially, in structural materials of transportation vehicles and the like high strengthened, influence of hydrogen is great. Therefore, the content of hydrogen should be 0.25 ml/100 g-Al or less.

(Unavoidable Impurities)

As the unavoidable impurities, elements of C, Ni, Na, Ca, V and the like can be assumed, however any of them are allowed to be included at a level not impeding the features of the present invention. More specifically, the elements of these unavoidable impurities are required that the content of each element is 0.3 mass % or less respectively, and that the total content is 1.0 mass % or less.

(Depth of Recrystallization)

Figure 6:
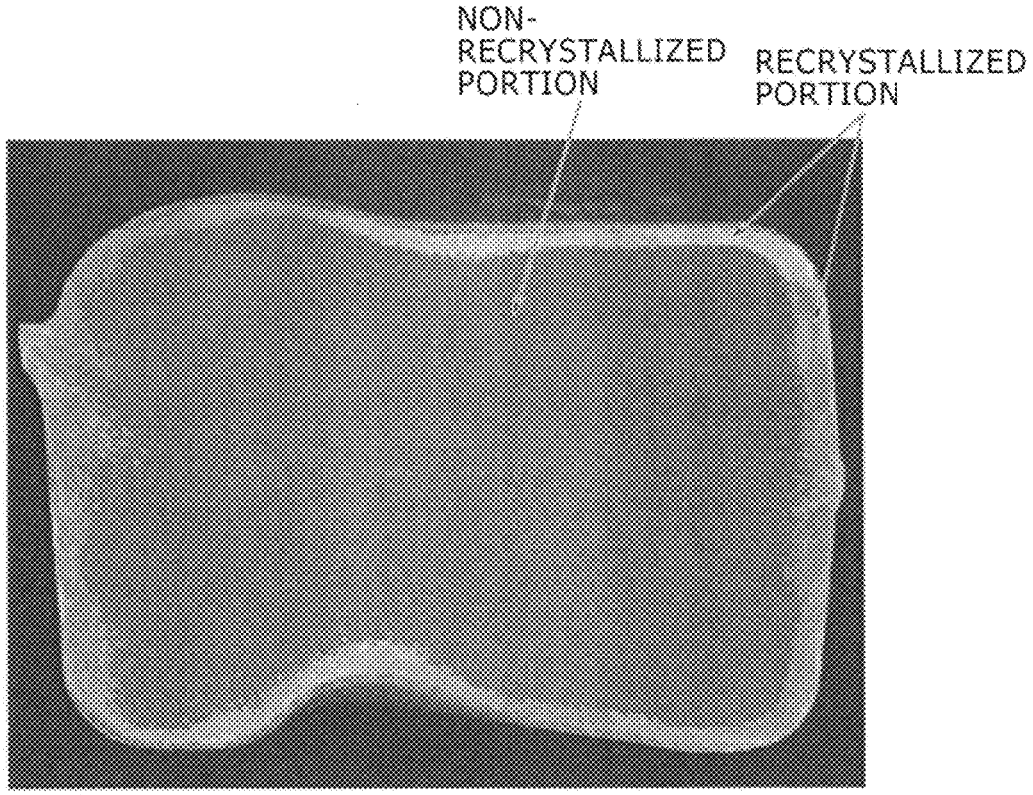
FIG. 6 is a drawing showing the recrystallized portion in the macroscopic structure observation of the cross section of the aluminum alloy forged material.

The depth of recrystallization from the surface of the aluminum alloy forged material in relation with the present invention is 5 mm or less. The recrystallization mentioned here means a phenomenon involving growth of the crystal grains, and an event that the crystal grains become larger than those after forging. As an example, FIG. 6 shows the recrystallized portion in the macroscopic structure observation of the cross section of the aluminum alloy forged material. In the macroscopic structure observation of FIG. 6, the portion looking white is made the recrystallized portion.

The depth of recrystallization in the present invention relates to the tensile strength of the aluminum alloy forged material. Because of friction with a die and cooling, the surface part of the aluminum alloy forged material is recrystallized more easily compared with the inner part. In the portion that has become the recrystallized structure, the tensile strength tends to become lower compared with the non-recrystallized structure. Therefore, the crack that becomes the start point of fracture by tension is liable to occur in the recrystallized structure. When the depth of the recrystallized structure from the surface becomes large, the crack is liable to develop, and variation in tensile strength becomes large which results in great drop of the tensile strength estimated at the time of designing. From this viewpoint, in order to achieve excellent tensile strength in the aluminum alloy forged material, the depth of recrystallization from the surface of the aluminum alloy forged material should be limited to 5 mm or less. The depth of recrystallization is preferable to be 3 mm or less, more preferably less than 1 mm.

In order to control the depth of recrystallization from the surface of the aluminum alloy forged material to 5 mm or less, with respect to the composition of the aluminum alloy, the content of Si, Fe and Mn in particular should be managed to a predetermined range. Also, with respect to the method for manufacturing the aluminum alloy forged material described below, it is necessary to strictly control the conditions in plural steps such as to arrange the heating step of executing heating at 500-560° C. for 0.75 hours or more after the homogenizing heat treatment step, to control the heat treatment temperature and the cooling rate of homogenizing heat treatment to a predetermined range, to control the starting temperature and the finishing temperature of the forging step to a predetermined range, to employ a predetermined condition as the temperature and the time of the solution heat treatment step, and the like.

Here, the depth of recrystallization can be measured by a method described below. The aluminum alloy forged material is cut by a cross section perpendicularly striding a parting line (PL) at a position where the cross-sectional area becomes the minimum or becomes extremely small. Here, the parting line means the boundary line of the surface of the forged material generated when the ingot is embraced by an upper die and a lower die in forging working (refer to FIG. 2). After the cut surface is paper-polished, it is etched by cupric chloride aqueous solution. Thereafter, after being immersed in nitric acid, water cleaning and drying by air blow, macroscopic structure observation of the cross section of the cut part is executed. The distance of the recrystallized portion from the surface is measured in the cross section of the cut part, and the distance at the position where the distance becomes the maximum is made the depth of recrystallization (mm).

Next, the method for manufacturing the aluminum alloy forged material for an automobile in relation with the present invention will be described. FIG. 1 is a flowchart showing the step S of the method for manufacturing the aluminum alloy forged material in relation with the present invention.

As shown in FIG. 1, the step S of the method for manufacturing in relation with the present invention includes a casting step S1, a homogenizing heat treatment step S2, a heating step S4, a forging step S6, a solution heat treatment step S7, a quenching step S8, and an artificial aging treatment step S9. Also, an extrusion working step S3 of subjecting the ingot to extrusion working may be executed after the homogenizing heat treatment step S2, and the heating step 4 may be executed thereafter. Further, a pre-form step S5 of subjecting the ingot to pre-form shaping may be executed after the heating step S4, and the forging step S6 may be executed thereafter. In order to obtain the aluminum alloy forged material for an automobile having excellent tensile strength and corrosion resistance in relation with the present invention, it is necessary to employ a predetermined condition with respect to not only the composition of the aluminum alloy described above but also the method for manufacturing.

In the method for manufacturing the aluminum alloy forged material for an automobile in relation with the present invention, with respect to the steps and conditions other than those specifically described below, manufacturing is possible by an ordinary method. Below, the conditions of each step will be described.

(Casting Step)

The casting step S1 is a step of casting molten metal that has been molten and adjusted to the chemical componential composition of the aluminum alloy to obtain an ingot. Also, casting is executed appropriately selecting ordinary melting and casting method such as a continuous casting method (hot top casting method for example), a semi-continuous casting method (DC casting method), and the like. Also, with respect to the shape of the ingot, an ingot of a round bar, a slab shape and the like can be cited, and the shape is not particularly limited.

In the casting step S1, the heating temperature should be 700-780° C. When the heating temperature is below 700° C., the temperature is liable to become lower than the solidifying temperature, the molten metal becomes liable to be solidified inside a tundish, the casting nozzle is blocked, and casting becomes impossible. When the heating temperature exceeds 780° C., the molten metal becomes hard to be solidified, so-called breeding in which the solidified shell is broken occurs in continuous casting, and continuous casting becomes impossible in this case also.

Also, the casting rate should be 200-400 mm/min. When the casting rate is less than 200 mm/min, the molten metal becomes liable to be solidified inside the tundish, the casting nozzle is blocked, and casting becomes impossible. Further, coarse crystallized products are generated in the solidified structure, and the tensile strength and variation are affected adversely. When the casting rate exceeds 400 mm/min, so-called breeding in which the solidified shell is broken is liable to occur, and continuous casting becomes impossible in this case also.

Also, in order to miniaturizing the crystal grains of the ingot, to reduce the average grain size of the Al—Fe—Si—(Mn, Cr)-based crystallized and precipitated products present on the grain boundary, and to increase the average interval between these crystallized and precipitated products, it is preferable to cool the molten metal at the cooling rate of 10° C./sec or more to obtain the ingot. When the cooling rate is slow, the average grain size of the Al—Fe—Si—(Mn, Cr)-based crystallized and precipitated products present on the grain boundary cannot be reduced, and the average interval between these crystallized and precipitated products cannot be increased.

(Homogenizing Heat Treatment Step)

The homogenizing heat treatment step S2 is a step of subjecting the ingot to predetermined homogenizing heat treatment. It is required that the ingot is subjected to temperature-raising at the rate of 0.5° C./min or more and less than 10° C./min, to homogenizing heat treatment at 480-560° C. for 2-12 hours, and to cooling at the rate of 1.0° C. or more to 300° C. or below. Here, the values of the temperature-raising rate and the cooling rate in the homogenizing heat treatment step in relation with the present invention show the values as the average values.

The temperature-raising rate is expressed by the average temperature-raising rate of the period from when the temperature of the ingot is the room temperature until when the temperature of the ingot reaches a predetermined homogenizing heat treatment temperature, and should be 0.5° C./min or more and less than 10° C./min. When the temperature-raising rate is less than 0.5° C./min, coarse Mg—Si-based precipitates are liable to be formed, the structure becomes heterogeneous because the dispersed particles are formed around the coarse Mg—Si-based precipitates, and recrystallization is liable to occur. When the temperature-raising rate is 10° C./min or more, coarse dispersed particles are liable to be formed, and recrystallization is liable to occur.

The object of the homogenizing heat treatment is to precipitate the dispersed particles having the size of approximately 5-500 nm by high density. By precipitating the dispersed particles by high density, grain boundary movement is suppressed more, and recrystallization can be suppressed. At this time, the most effective temperature is 480-560° C., and the homogenizing heat treatment should be executed for 2 hours or more in order to effect sufficient precipitation. When the heat treatment temperature deviates from the range of 480-560° C., the dispersed particles having the effect of suppressing recrystallization are less or become excessively coarse, and the suppressing effect is weakened. When the heat treatment time is less than 2 hours, the dispersed particles cannot be formed sufficiently. Also, the heat treatment time is preferable to be 12 hours or less from the viewpoint of the productivity.

The cooling rate after the homogenizing heat treatment is expressed by the average cooling rate for the period from when the temperature of the ingot is the homogenizing heat treatment temperature until when the temperature of the ingot reaches 300° C. or below, and it is necessary to execute cooling at 1.0° C./min or more. When the cooling rate is less than 1.0° C./min, precipitates such as coarse $Mg_2Si$ and the like are formed in the middle of cooling, and therefore the effect of the dispersed particles deterioates. Also, such effect of deterioration of the workability and the like afterwards arises.

For the homogenizing heat treatment, an air furnace, induction heating furnace, niter furnace and the like are used appropriately.

(Extrusion Working Step)

In the present invention, an extrusion working step S3 of extrusion working of the ingot can be executed after the homogenizing heat treatment step S2, and the heating step 4 can be executed thereafter. Adding the extrusion working step S3 is preferable from the viewpoint of further improving the tensile strength and toughness because a fibrous structure is achieved.

In the present invention, when the extrusion working step S3 is not executed, peeling may be executed after the casting step S1 or after the homogenizing heat treatment step S2. After casting, a segregation phase may possibly be formed on the surface of the cast product. In the segregation phase, the additive elements are present by a larger amount than that in the inside of the cast product, and the segregation phase is harder and more brittle than the inside of the cast product. Therefore, in order to remove the segregation phase on the surface, peeling can be executed before plastic working is executed in the forging step S6.

(Heating Step)

The heating step S4 is a step required for reducing the deformation resistance in the forging step S6, for reducing the strain caused by forging working, and for suppressing recrystallization. Because the heating step S4 is a step executed for optimizing the forging working, the temperature equal to or higher than the forging temperature is required.

In the heating step S4, the ingot having been subjected to the homogenizing heat treatment is required to be heated at 500-560° C. for 0.75-6 hours. When the heating temperature is lower than 500° C., the effect described above cannot be secured, whereas when the heating temperature is higher than 560° C., voids remain inside the product due to eutectic fusion, the defect such as forging crack, eutectic fusion and the like is liable to occur in the forging step S6, and the strength may extremely drops. When the heating time is less than 0.75 hour, heating may not be executed fully homogenously to the center part of the material, and the effect described above may not be secured. Also, from the viewpoint of maintaining the dispersed particles formed in the homogenizing heat treatment, the heating time is preferable to be 6 hours or less.

(Pre-Form Step)

In the present invention, the pre-form step S5 of pre-form shaping the ingot can be executed after the heating step S4, and the forging step S6 can be executed thereafter. Formation of pre-form is executed using a forging roll and the like. Formation of pre-form is executed for example by working such as reducing the outside diameter cross-sectional area while rotating the bar-like ingot. When the pre-form step S5 is executed, the alloy amount discharged as the burr reduces which is preferable because the yield of the material is improved. When the temperature of the ingot lowers than the predetermined forging start temperature after the pre-form step S5, by reheating the ingot after pre-form shaping, predetermined forging start temperature can be attained.

(Forging Step)

The forging step S6 is a step of using the ingot having been subjected to homogenizing heat treatment as a raw material for forging, and subjecting the ingot to hot forging by mechanical forging, oil hydraulic forging and the like to obtain the forged material of a predetermined shape. At this time, the start temperature of forging of the raw material for forging is to be 450-560° C. When the start temperature is lower than 450° C., deformation resistance increases, sufficient working cannot be executed, the strain caused by forging working rises, and therefore recrystallization is liable to occur. When the start temperature is higher than 560° C., the defect such as forging crack, eutectic fusion and the like is liable to occur.

In order to deform the ingot into a predetermined shape, forging working can be executed plural times according to the necessity. In such case, in order to secure the predetermined forging finish temperature, reheating may be executed in the middle of the forging step S6.

Also, the finish temperature of forging of the raw material for forging is to be 360° C. or above. When the finish temperature is below 360° C., the strain caused by forging working becomes high, and therefore recrystallization is liable to occur. Further, in order to reduce the strain caused by forging working, the finish temperature of forging is preferable to be as high as possible.

(Solution Heat Treatment Step)

The solution heat treatment step S7 is a step of relaxing the strain introduced in the forging step S6 and solid-resolving solute elements. In the solution heat treatment step S7, the forged material should be subjected to solution heat treatment at 500-560° C. for more than 0 hour and 24 hours or less. When the treatment temperature is lower than 500° C., solution heat treatment does not progress, and high strengthening by aging precipitation cannot be expected. When the treatment temperature exceeds 560° C., although solid solution of the solute elements is promoted more, eutectic fusion and recrystallization are liable to occur. Also, when the treatment time exceeds 24 hours, because the dispersed particles having been suppressing recrystallization are coarsened or eliminated, recrystallization is liable to occur.

Also, in the solution heat treatment, in order to assure the 0.2% proof stress, it is preferable that the retention time is 20 min-20 hours and the temperature raising rate (average temperature raising rate) is 100° C./hour or more.

For the solution heat treatment, an air furnace, induction heating furnace, niter furnace and the like are used appropriately.

(Quenching Step)

The quenching step S8 is a step of subjecting the forged material having been subjected to the solution heat treatment to quenching treatment at 75° C. or below, and is normally executed by cooling in the water or in the warm water. When the treatment temperature exceeds 75° C., quench hardening at a sufficient cooling rate is impossible, coarse Mg—Si-based precipitates are formed, and therefore sufficient tensile strength cannot be secured in the artificial aging treatment step S9 thereafter.

(Artificial Aging Treatment Step)

The artificial aging treatment step S9 is a step of subjecting the forged material having been subjected to the quenching to artificial aging treatment at 140-200° C. for 1-24 hours.

When the treatment temperature is below 140° C. or the treatment time is less than 1 hour, the Mg—Si-based precipitates that improve the tensile strength cannot grow sufficiently. Also, when the treatment temperature is higher than 200° C. or the treatment time is longer than 24 hours, the Mg—Si-based precipitates become excessively coarse, and the effect of improving the tensile strength reduces.

Also, for the artificial age hardening treatment, an air furnace, induction heating furnace, oil bath and the like are used appropriately.

EXAMPLES

Next, the present invention will be described based on examples. Also, the present invention is not limited by the examples described below.

The properties evaluated in the invention examples and comparative examples are as described below.

[Alloy Composition]

The alloy composition was measured using an emission spectrophotometer OES-1014 made by Shimadzu Corporation. The position of measurement of the product is not particularly limited as far as measurement is possible. The emission spectrophotometer was operated according to the operation manual.

[Tensile Test]

The tensile strength, 0.2% proof stress and elongation were measured according to the stipulation of JIS Z 2241 using the No. 5 specimen stipulated in JIS Z 2201. The average value of the measured values of 30 specimens was obtained. As an indicator of variation of the tensile strength, the standard deviation σ was obtained. The tensile strength of 340 MPa or more, the 0.2% proof stress of 320 MPa or more, the elongation of 10.0% or more, and the standard deviation σ of 6.0 MPa or less were determined to have passed.

[Stress Corrosion Cracking Resistance (SCC)]

Figure 4A:
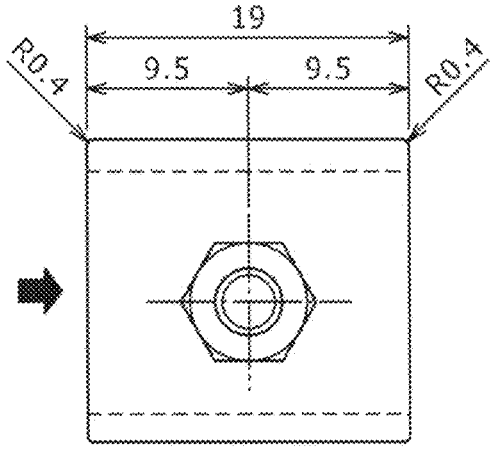
FIG. 4A is a plan view showing the dimension of a specimen for evaluating the stress corrosion crack resistance (C-ring for SCC test) described in the invention examples and the comparative examples.
Figure 4B:
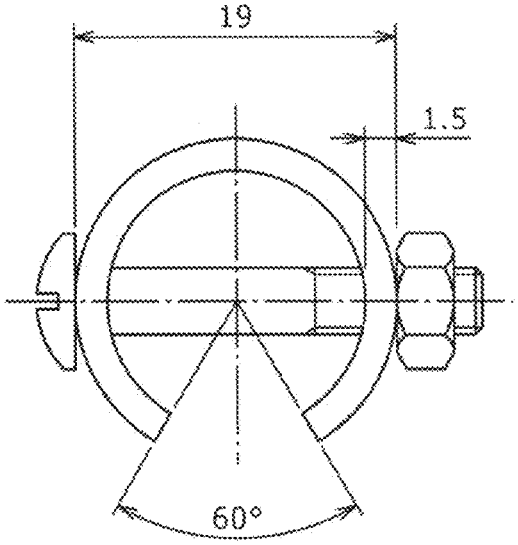
FIG. 4B is a side view as viewed from the direction of the arrow mark in FIG. 4A and shows the dimension of a specimen for evaluating the stress corrosion crack resistance (C-ring for SCC test) described in the invention example and the comparative example.

The stress corrosion cracking resistance was measured according to the stipulation of the alternate immersion method of JIS H 8711. FIG. 4 shows the dimension of the specimen for evaluating the stress corrosion cracking resistance (C-ring for SCC test).

Those with less than 30 days of the stress corrosion cracking when 300 MPa had been applied were evaluated to be poor, those with 30 days or more and less than 60 days were evaluated to be good, and those with 60 days or more were evaluated to be excellent. Those good or excellent were determined to have passed.

[Depth of Recrystallization]

The depth of recrystallization was measured by the condition described below.

The sample for measurement was cut by a cross section perpendicularly striding the parting line (PL) at a position where the cross-sectional area became the minimum. After the cut surface was polished with water-proof paper of #600 to #1,000, the sample was etched by cupric chloride aqueous solution. Thereafter, after being immersed in nitric acid, water cleaning and drying by air blow, macroscopic structure observation of the cross section of the cut part was executed. The distance of the recrystallized portion from the surface was measured in the cross section of the cut part, and the distance at a position where the distance became the maximum was made the depth of recrystallization T (mm).

Those with the depth of recrystallization exceeding 5 mm were evaluated to be poor, those 1 mm or more and 5 mm or less were evaluated to be good, and those with less than 1 mm were evaluated to be excellent. Those good or excellent were determined to have passed.

Invention Examples 1-11, Comparative Examples 1-21

Al alloys having various alloy compositions shown in Table 1 were cast into round bars with 80 mm diameter×100 mm length at the heating temperature of 720° C. and the casting rate of 250 mm/min by the hot top casting method. Also, the hydrogen amount in the Al alloy was measured at the time of casting. Thereafter, the ingot was subjected to homogenizing heat treatment by temperature-raising at the temperature raising rate of 3° C./min, holding by 540° C.×8 hours, and cooling at 1.5° C./min to 300° C. or below.

Thereafter, the ingot was subjected to heating treatment by heating to 520° C. and holding for 1.5 hours using an air furnace. Then, hot forging was executed with the forging start temperature of 520° C. and the forging finish temperature of 440° C. so that the total forging draft became 70% by mechanical forging using upper and lower molds, and the Al alloy forged material of a disk shape with 145 mm diameter× 30 mm thickness was manufactured.

Further, the Al alloy forged material was subjected to solution heat treatment at 540° C. for 8 hours by the air furnace, was water-cooled (water-quenched) by the water of 60° C., and was thereafter subjected to artificial aging treatment at 175° C. for 8 hours by the air furnace.

Figure 2:
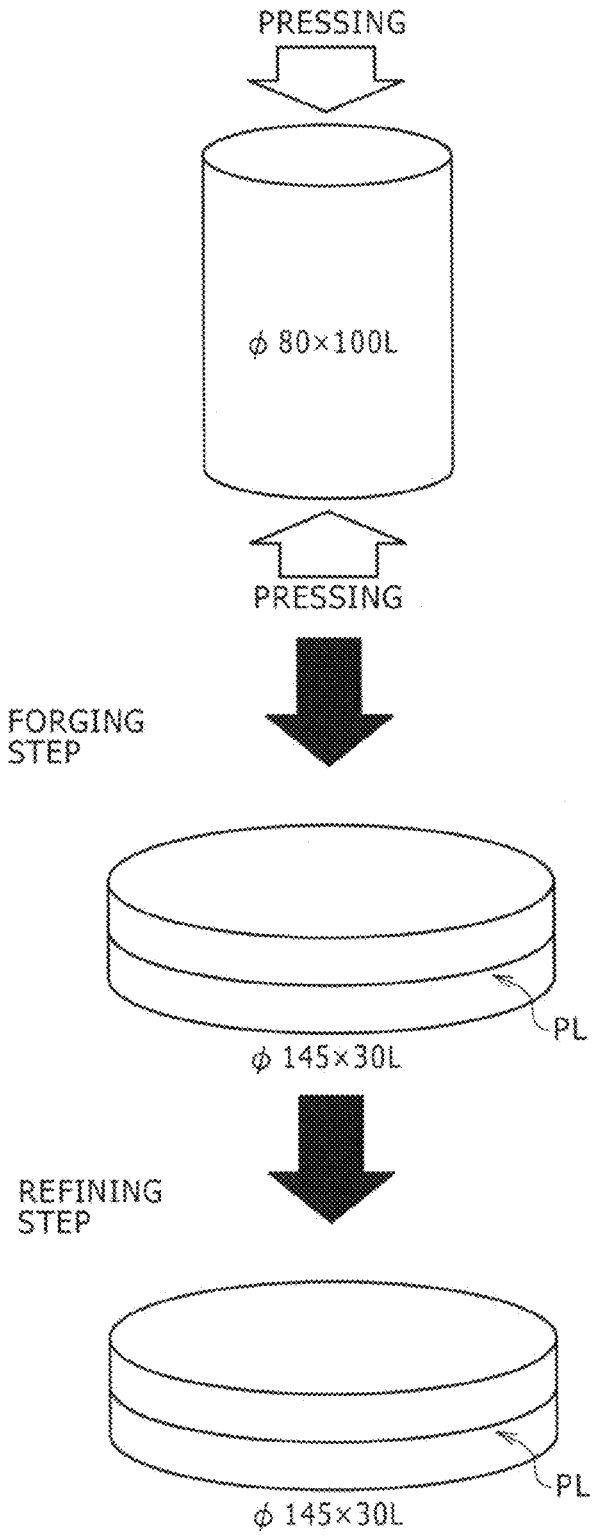
FIG. 2 is a schematic drawing showing the manufacturing steps of the aluminum alloy forged material for an automobile described in the invention examples and the comparative examples.

FIG. 2 is a schematic drawing showing the manufacturing steps of the aluminum alloy forged material for the evaluation described above. In FIG. 2, the solution heat treatment step S7, the quenching step S8 and the artificial aging treatment step S9 are shown collectively under the name of the refining step. As shown in FIG. 2, the cast product of a circular cylindrical shape is pressed into a forged product of a disk shape in the forging step S6, and the forged material in relation with the present invention is thereafter manufactured while going through the refining step. On the forged product and the forged material of the disk shape, the parting lines (PL) are shown.

Figure 3:
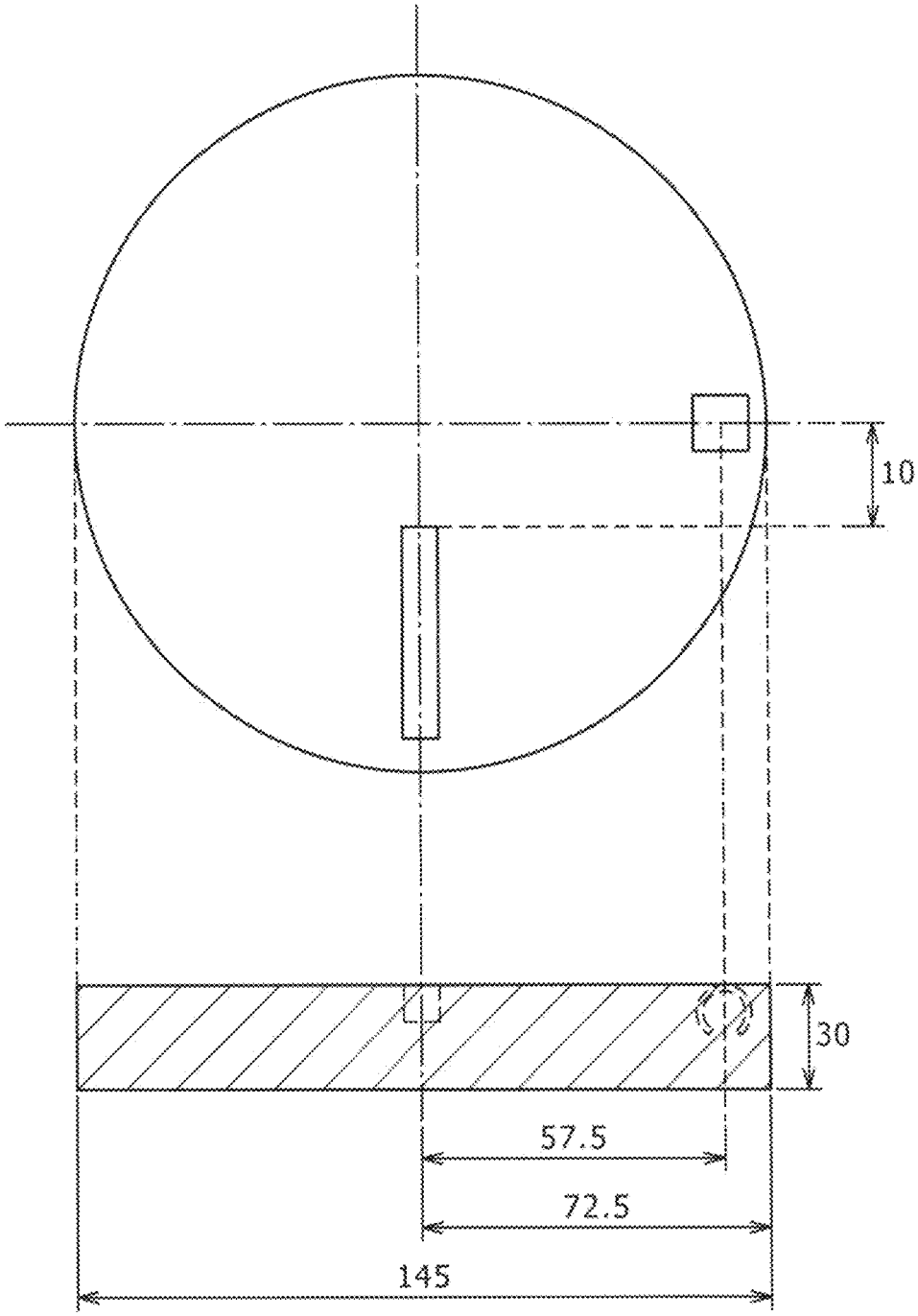
FIG. 3 is a drawing showing the position where the specimen for evaluation is taken and the position where the depth of recrystallization is measured described in the invention examples and the comparative examples.

From the disk of the aluminum alloy forged material obtained thus, a specimen for tensile test and a specimen for evaluating stress corrosion cracking resistance (SCC) (C-ring) were taken at positions shown in FIG. 3. In FIG. 3, the dimensions in the plan view and the cross-sectional view of the aluminum alloy forged material of the disk shape are shown. Also, the disk of FIG. 3 was cut along the diameter thereof, the cut surface was observed, and the depth of recrystallization of the position where the distance of the recrystallized portion from the surface became the maximum was measured. The result of evaluation was shown in Table 2.

Figure 5A:
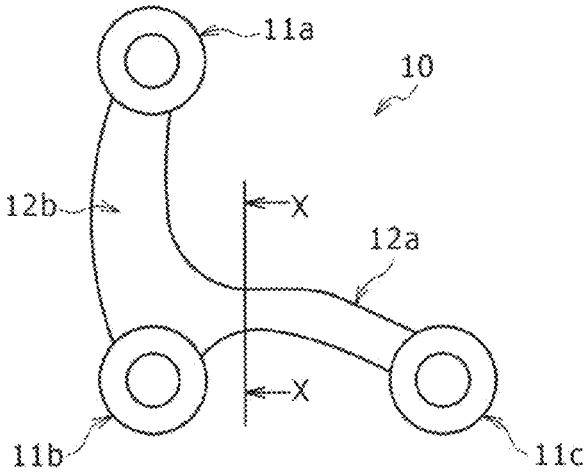
FIG. 5A is a drawing showing the position where the depth of recrystallization is measured in the aluminum alloy forged material of the shape of an L-type chassis member for an automobile.
Figure 5B:
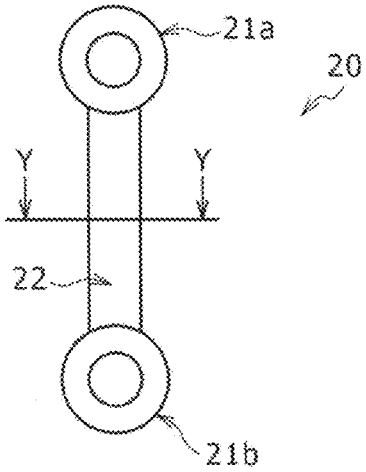
FIG. 5B is a drawing showing the position where the depth of recrystallization is measured in the aluminum alloy forged material of the shape of an I-type chassis member for an automobile.

Also, FIG. 5A and FIG. 5B specifically show the cutting position, that is the position for measuring the depth of recrystallization, in the Al alloy forged material 10 of the shape of an L-type chassis member for an automobile and the Al alloy forged material 20 of the shape of an I-type chassis member for an automobile which are representative uses of the present invention. As shown in FIG. 5A, the Al alloy forged material 10 of the shape of the L-type chassis member for an automobile is composed of three joint sections 11*a*, 11*b*, 11*c* and two arm sections 12*a*, 12*b*. The cutting plane X-X cuts the arm section 12*a* of one of them. As shown in FIG. 5B, the Al alloy forged material 20 of the shape of the I-type chassis member for an automobile is composed of two joint sections 21*a*, 21*b* and one arm section 22. The cutting plane Y-Y cuts the arm section 22.

Figure 7:
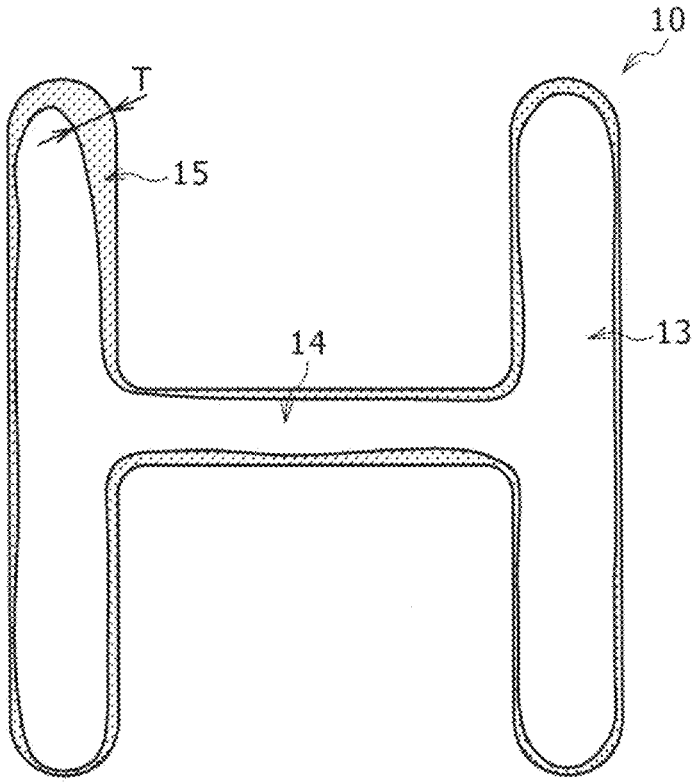
FIG. 7 is a drawing schematically showing the recrystallized portion in the macroscopic structure observation in the cutting plane of the aluminum alloy forged material of a shape of a chassis member for an automobile of FIG. 5A.

FIG. 7 is a drawing schematically showing a recrystallized portion 15 obtained by the macroscopic structure observation in the cutting plane X-X of the aluminum alloy forged material 10 of the shape of the L-type chassis member of an automobile shown in FIG. 5A. As shown in FIG. 7, the cross section has an H-like cross-sectional shape formed of ribs 13 and a web 14. The recrystallized portion 15 in the vicinity of the surface was shown by dots. The distance from the surface at a position T where the distance became the maximum out of the recrystallized portion 15 was made the depth of recrystallization.

TABLE 1

| | Alloy composition (mass %), remainder: Al | | | | | | | | | |
|---|---|---|---|---|---|---|---|---|---|---|
| No. | Si | Fe | Mg | Ti | Mn | Cr/selected | Zr/selected | Cu | Zn | $H_2$ |
| Whether criteria of claims are satisfied | 0.7-1.5 | 0.1-0.5 | 0.6-1.2 | 0.01-0.1 | 0.3-1.0 | 0.1-0.4 | 0.01-0.2 | ≤0.10 | ≤0.05 | ≤0.25 |
| Invention example 1 | 0.70 | 0.22 | 0.90 | 0.02 | 0.70 | 0.20 | <0.01 | 0.05 | <0.02 | 0.15 |
| Invention example 2 | 1.20 | 0.05 | 0.90 | 0.02 | 0.70 | 0.20 | <0.01 | 0.05 | <0.02 | 0.15 |
| Invention example 3 | 1.20 | 0.22 | 0.90 | 0.02 | 0.70 | 0.20 | <0.01 | 0.05 | <0.02 | 0.15 |
| Invention example 4 | 1.20 | 0.22 | 0.90 | 0.02 | 1.00 | 0.20 | <0.01 | 0.05 | <0.02 | 0.15 |
| Invention example 5 | 1.20 | 0.22 | 0.90 | 0.02 | 0.30 | 0.20 | <0.01 | 0.05 | <0.02 | 0.15 |
| Invention example 6 | 1.20 | 0.22 | 0.60 | 0.02 | 0.70 | 0.20 | <0.01 | 0.05 | <0.02 | 0.15 |
| Invention example 7 | 1.20 | 0.22 | 0.90 | 0.10 | 0.70 | 0.20 | <0.01 | 0.05 | <0.02 | 0.15 |
| Invention example 8 | 1.20 | 0.22 | 0.90 | 0.10 | 0.70 | <0.03 | 0.10 | 0.05 | <0.02 | 0.15 |
| Invention example 9 | 1.20 | 0.22 | 0.90 | 0.02 | 0.70 | 0.20 | 0.15 | 0.05 | <0.02 | 0.15 |
| Invention example 10 | 1.20 | 0.22 | 0.90 | 0.02 | 0.70 | 0.20 | <0.01 | <0.01 | <0.02 | 0.15 |
| Invention example 11 | 1.50 | 0.22 | 0.90 | 0.02 | 0.70 | 0.20 | <0.01 | 0.05 | <0.02 | 0.15 |
| Comparative example 1 | 0.60 | 0.22 | 0.90 | 0.02 | 0.70 | 0.20 | <0.01 | 0.05 | <0.02 | 0.15 |
| Comparative example 2 | 1.60 | 0.22 | 0.90 | 0.02 | 0.70 | 0.20 | <0.01 | 0.05 | <0.02 | 0.15 |
| Comparative example 3 | 1.20 | 0.05 | 0.90 | 0.02 | 0.70 | 0.20 | <0.01 | 0.05 | <0.02 | 0.15 |
| Comparative example 4 | 1.20 | 0.60 | 0.90 | 0.02 | 0.70 | 0.20 | <0.01 | 0.05 | <0.02 | 0.15 |
| Comparative example 5 | 1.20 | 0.22 | 0.90 | 0.02 | 0.70 | 0.20 | <0.01 | 0.30 | <0.02 | 0.15 |
| Comparative example 6 | 1.20 | 0.22 | 0.50 | 0.02 | 0.70 | 0.20 | <0.01 | 0.05 | <0.02 | 0.15 |
| Comparative example 7 | 1.20 | 0.22 | 1.30 | 0.02 | 0.70 | 0.20 | <0.01 | 0.05 | <0.02 | 0.15 |
| Comparative example 8 | 1.20 | 0.22 | 1.00 | <0.004 | 0.70 | 0.20 | <0.01 | 0.05 | <0.02 | 0.15 |
| Comparative example 9 | 1.20 | 0.22 | 1.00 | 0.15 | 0.70 | 0.20 | <0.01 | 0.05 | <0.02 | 0.15 |
| Comparative example 10 | 1.20 | 0.22 | 1.00 | 0.02 | 0.70 | 0.20 | <0.01 | 0.05 | 0.10 | 0.15 |
| Comparative example 11 | 1.20 | 0.22 | 0.90 | 0.02 | 0.20 | 0.20 | <0.01 | 0.05 | <0.02 | 0.15 |
| Comparative example 12 | 1.20 | 0.22 | 0.90 | 0.02 | 1.40 | 0.20 | <0.01 | 0.05 | <0.02 | 0.15 |
| Comparative example 13 | 1.20 | 0.22 | 0.90 | 0.02 | 0.70 | <0.03 | <0.01 | 0.05 | <0.02 | 0.15 |
| Comparative example 14 | 1.20 | 0.22 | 1.00 | 0.02 | 0.70 | <0.03 | 0.50 | 0.05 | <0.02 | 0.15 |
| Comparative example 15 | 1.20 | 0.22 | 1.00 | 0.02 | 0.70 | 0.05 | <0.01 | 0.05 | <0.02 | 0.15 |
| Comparative example 16 | 1.20 | 0.22 | 1.00 | 0.02 | 0.70 | 0.50 | <0.01 | 0.05 | <0.02 | 0.15 |
| Comparative example 17 | 1.20 | 0.22 | 1.00 | 0.02 | 0.70 | 0.45 | 0.30 | 0.05 | <0.02 | 0.15 |
| Comparative example 18 | 1.20 | 0.22 | 1.00 | 0.02 | 0.70 | 0.20 | <0.01 | 0.05 | <0.02 | 0.30 |
| Comparative example 19 | 0.60 | 0.22 | 0.90 | 0.02 | 0.30 | 0.20 | <0.01 | 0.05 | <0.02 | 0.30 |
| Comparative example 20 | 1.55 | 0.22 | 1.10 | 0.02 | 1.00 | 0.20 | <0.01 | 0.05 | <0.02 | 0.30 |
| Comparative example 21 | 1.60 | 0.22 | 0.50 | 0.02 | 0.70 | 0.20 | <0.01 | 0.05 | <0.02 | 0.30 |

TABLE 2

| No | Depth of recrystallization (mm) | Depth of recrystallization (determined) | Mechanical properties: average value — Tensile strength (MPa) Average value | Tensile strength (MPa) Variation | 0.2% proof stress (MPa) | Elongation (%) | Stress corrosion cracking resistance (determined) |
|---|---|---|---|---|---|---|---|
| Whether criteria of claims are satisfied | ≤5.0 | | ≥340 | σ ≤ 6.0 | ≥320 | ≥10.0 | |
| Invention example 1 | 4 | Good | 343 | 5.0 | 323 | 18.7 | Excellent |
| Invention example 2 | 5 | Good | 365 | 5.7 | 341 | 18.6 | Good |
| Invention example 3 | 1 | Good | 386 | 2.3 | 364 | 15.5 | Excellent |
| Invention example 4 | <0.2 | Excellent | 379 | 1.9 | 355 | 10.8 | Good |
| Invention example 5 | 5 | Good | 396 | 5.5 | 371 | 17.2 | Good |
| Invention example 6 | 2 | Good | 375 | 4.4 | 352 | 16.1 | Good |
| Invention example 7 | 1 | Good | 383 | 2.7 | 364 | 14.3 | Excellent |
| Invention example 8 | <0.2 | Excellent | 383 | 1.3 | 365 | 13.2 | Excellent |
| Invention example 9 | <0.2 | Excellent | 387 | 1.6 | 363 | 16.0 | Excellent |
| Invention example 10 | 1 | Good | 381 | 2.5 | 360 | 14.9 | Excellent |
| Invention example 11 | 1 | Good | 411 | 3.0 | 385 | 14.6 | Good |
| Comparative example 1 | 5 | Good | 324 | 5.5 | 301 | 19.2 | Excellent |
| Comparative example 2 | 1 | Good | 392 | 2.1 | 370 | 12.3 | Poor |
| Comparative example 3 | 6 | Poor | 328 | 6.3 | 305 | 20.1 | Excellent |
| Comparative example 4 | 2 | Good | 392 | 3.3 | 370 | 9.7 | Good |
| Comparative example 5 | 1 | Good | 388 | 2.9 | 366 | 16.1 | Poor |
| Comparative example 6 | 3 | Good | 339 | 4.5 | 316 | 17.3 | Poor |
| Comparative example 7 | 1 | Good | 366 | 2.8 | 340 | 4.2 | Good |
| Comparative example 8 | 1 | Good | 337 | 2.8 | 325 | 7.8 | Poor |
| Comparative example 9 | 1 | Good | 381 | 2.1 | 362 | 6.2 | Good |
| Comparative example 10 | 5 | Good | 338 | 6.1 | 319 | 16.4 | Poor |
| Comparative example 11 | 8 | Poor | 336 | 11.4 | 315 | 16.9 | Poor |
| Comparative example 12 | <0.2 | Excellent | 375 | 2.3 | 354 | 6.1 | Good |
| Comparative example 13 | 7 | Poor | 333 | 8.7 | 310 | 16.2 | Poor |
| Comparative example 14 | <0.2 | Excellent | 330 | 1.5 | 328 | 4.1 | Good |
| Comparative example 15 | 6 | Poor | 339 | 7.8 | 315 | 15.6 | Poor |
| Comparative example 16 | <0.2 | Excellent | 334 | 1.4 | 310 | 9.5 | Poor |
| Comparative example 17 | <0.2 | Excellent | 345 | 2.0 | 321 | 7.5 | Good |
| Comparative example 18 | 1 | Good | 377 | 3.0 | 355 | 8.6 | Excellent |
| Comparative example 19 | 9 | Poor | 311 | 9.6 | 287 | 21.4 | Good |
| Comparative example 20 | <0.2 | Excellent | 396 | 2.2 | 374 | 8.8 | Poor |
| Comparative example 21 | 1 | Good | 402 | 2.8 | 398 | 6.7 | Poor |

As shown in Table 1 and Table 2, the forged materials formed of the Al alloy satisfying the stipulation of the claim 1 of the present invention (invention examples 1-11) were less in variation of the tensile strength, and were excellent in tensile strength, 0.2% proof stress, elongation, and stress corrosion cracking resistance. On the other hand, the forged materials formed of the Al alloy not satisfying the stipulation of the present invention (comparative examples 1-21) were inferior in any one or more out of the tensile strength, 0.2% proof stress, elongation, and stress corrosion cracking resistance. In Table 1, the condition not satisfying the stipulation of the present invention was shown by drawing an underline under the figure. Also, in the alloy composition of Table 1, the figure attached with a mark "<" shows to be less than the figure after the mark. In this case, it is shown that the figure after the mark is the detection limit of the measuring apparatus.

Invention Examples 12-18, Comparative Examples 22-45

Aluminum alloy forged materials were manufactured similarly to the invention examples 1-11 using an aluminum alloy with the composition described in the invention example 3, that is Si: 1.2 mass %, Fe: 0.22 mass %, Mg: 0.90 mass %, Ti: 0.02 mass %, Mn: 0.70 mass %, Cr: 0.20, Zr: less than 0.01 mass %, Cu: 0.05 mass %, Zn: less than 0.02 mass %, and the hydrogen amount: 0.15 ml/100 g-Al, the remainder being Al and unavoidable impurities, and using the manufacturing condition described in Table 3. Also, the hydrogen amount in the Al alloy was measured at the time of casting.

From the disk of the aluminum alloy forged material obtained thus, a specimen for tensile test and a specimen for evaluating stress corrosion cracking resistance (SCC) (C-ring) were taken at positions shown in FIG. 3 similarly to the invention examples 1-11. Also, the disk of FIG. 3 was cut along the diameter thereof, the cut surface was observed, and the depth of recrystallization of the position where the distance of recrystallized portion from the surface became the maximum was measured. The result of evaluation was shown in Table 4.

TABLE 3

| No. | Casting step | | Homogenizing heat treatment step | | | | Heating step | | Forging step | | Solution heat treatment | | Quenching | Artificial aging treatment step | |
|---|---|---|---|---|---|---|---|---|---|---|---|---|---|---|---|
| | Casting temperature (° C.) | Casting rate (mm/min) | Temperature raising rate (° C./min) | Temperature (° C.) | Treatment time (hour) | Cooling rate (° C./min) | Heating temperature (° C.) | Heating time (hour) | Start temperature (° C.) | Finish temperature (° C.) | Temperature (° C.) | Treatment time (hour) | step Temperature (° C.) | Temperature (° C.) | Treatment time (hour) |
| Whether criteria of claims are satisfied | 700-780 | 200-400 | 0.5-less than 10 | 480-560 | ≥2 | ≥1.0 (~300° C.) | 500-560 | ≥0.75 | 450-560 | ≥360 | 500-560 | Over 0-24 | ≤75 | 140-200 | 1-24 |
| Invention example 12 | 700 | 380 | 1 | 560 | 4 | 1.5 | 540 | 1 | 500 | 395 | 555 | 6 | 45 | 200 | 1 |
| Invention example 13 | 720 | 330 | 1 | 540 | 8 | 10.0 | 500 | 2 | 480 | 375 | 540 | 8 | 60 | 175 | 8 |
| Invention example 14 | 720 | 330 | 1 | 540 | 48 | 1.5 | 540 | 2 | 500 | 395 | 540 | 8 | 60 | 175 | 8 |
| Invention example 15 | 720 | 340 | 1 | 560 | 4 | 1.0 | 540 | 1 | 540 | 420 | 560 | 1 | 60 | 140 | 24 |
| Invention example 16 | 720 | 350 | 10 | 540 | 8 | 1.5 | 560 | 1 | 560 | 425 | 500 | 12 | 40 | 180 | 5 |
| Invention example 17 | 780 | 210 | 1 | 500 | 12 | 1.5 | 500 | 2 | 450 | 360 | 520 | 24 | 75 | 180 | 5 |
| Invention example 18 | 720 | 280 | 3 | 500 | 7 | 2.5 | 540 | 1 | 520 | 420 | 555 | 4 | 40 | 180 | 5 |
| Comparative example 22 | 680 | 330 | 1 | | | | | | | | | | | | |
| Comparative example 23 | 850 | 330 | 1 | | | | | | | | | | | | |
| Comparative example 24 | 720 | 150 | 1 | 540 | 8 | 1.5 | 540 | 2 | 500 | 395 | 540 | 8 | 60 | 175 | 8 |
| Comparative example 25 | 720 | 470 | 1 | | | | | | | | | | | | |
| Comparative example 26 | 720 | 330 | 0.1 | 540 | 8 | 1.5 | 540 | 2 | 500 | 395 | 540 | 8 | 60 | 175 | 8 |
| Comparative example 27 | 720 | 330 | 15 | 540 | 8 | 1.5 | 540 | 2 | 500 | 395 | 540 | 8 | 60 | 175 | 8 |
| Comparative example 28 | 720 | 330 | 1 | 450 | 8 | 1.5 | 540 | 2 | 500 | 395 | 540 | 8 | 60 | 175 | 8 |
| Comparative example 29 | 720 | 330 | 1 | 580 | 8 | 1.5 | 540 | 2 | 500 | 395 | 540 | 8 | 60 | 175 | 8 |
| Comparative example 30 | 720 | 330 | 1 | 540 | 1 | 1.5 | 540 | 2 | 500 | 395 | 540 | 8 | 60 | 175 | 8 |
| Comparative example 31 | 720 | 330 | 1 | 540 | 8 | 0.8 | 540 | 2 | 500 | 395 | 540 | 8 | 60 | 175 | 8 |
| Comparative example 32 | 720 | 330 | 1 | 540 | 8 | 0.3 | 540 | 2 | 500 | 395 | 540 | 8 | 60 | 175 | 8 |
| Comparative example 33 | 720 | 330 | 1 | 540 | 8 | 1.5 | 450 | 2 | 500 | 395 | 540 | 8 | 60 | 175 | 8 |
| Comparative example 34 | 720 | 330 | 1 | 540 | 8 | 1.5 | 580 | 2 | 500 | 395 | 540 | 8 | 60 | 175 | 8 |

TABLE 3-continued

| No. | Casting step | | Homogenizing heat treatment step | | | | Heating step | | Forging step | | Solution heat treatment | | Quenching | Artificial aging treatment step | |
|---|---|---|---|---|---|---|---|---|---|---|---|---|---|---|---|
| | Casting temperature (° C.) | Casting rate (mm/min) | Temperature raising rate (° C./min) | Temperature (° C.) | Treatment time (hour) | Cooling rate (° C./min) | Heating temperature (° C.) | Heating time (hour) | Start temperature (° C.) | Finish temperature (° C.) | Temperature (° C.) | Treatment time (hour) | step Temperature (° C.) | Temperature (° C.) | Treatment time (hour) |
| Comparative example 35 | 720 | 330 | 1 | 540 | 8 | 1.5 | 520 | 0.50 | 500 | 395 | 540 | 8 | 60 | 175 | 8 |
| Comparative example 36 | 720 | 330 | 1 | 540 | 8 | 1.5 | 500 | 2 | 430 | 345 | 540 | 8 | 60 | 175 | 8 |
| Comparative example 37 | 720 | 330 | 1 | 540 | 8 | 1.5 | 580 | 2 | 580 | 435 | | | | | |
| Comparative example 38 | 720 | 330 | 1 | 540 | 8 | 1.5 | 520 | 2 | 500 | 395 | 450 | 8 | 60 | 175 | 8 |
| Comparative example 39 | 720 | 330 | 1 | 540 | 8 | 1.5 | 520 | 2 | 500 | 395 | 600 | 8 | 60 | 175 | 8 |
| Comparative example 40 | 720 | 330 | 1 | 540 | 8 | 1.5 | 520 | 2 | 500 | 395 | 540 | 48 | 60 | 175 | 8 |
| Comparative example 41 | 720 | 330 | 1 | 540 | 8 | 1.5 | 520 | 2 | 500 | 395 | 540 | 8 | 90 | 175 | 8 |
| Comparative example 42 | 720 | 330 | 1 | 540 | 8 | 1.5 | 520 | 2 | 500 | 395 | 540 | 8 | 60 | 120 | 8 |
| Comparative example 43 | 720 | 330 | 1 | 540 | 8 | 1.5 | 520 | 2 | 500 | 395 | 540 | 8 | 60 | 250 | 8 |
| Comparative example 44 | 720 | 330 | 1 | 540 | 8 | 1.5 | 520 | 2 | 500 | 395 | 540 | 8 | 60 | 175 | 0.5 |
| Comparative example 45 | 720 | 330 | 1 | 540 | 8 | 1.5 | 520 | 2 | 500 | 395 | 540 | 8 | 60 | 175 | 30 |

TABLE 4

| No. | Depth of recrystallization (determined) | Mechanical properties: average value Tensile strength (MPa) Average value | Variation | 0.2% proof stress (MPa) | Elongation (%) | Stress corrosion cracking resistance (determined) | Remarks |
|---|---|---|---|---|---|---|---|
| Whether criteria of claims are satisfied | ≤5.0 | ≥340 | σ ≤ 6.0 | ≥320 | ≥10.0 | | |
| Invention example 12 | Excellent | 364 | 1.7 | 341 | 10.7 | Good | |
| Invention example 13 | Excellent | 386 | 1.5 | 364 | 15.5 | Excellent | |
| Invention example 14 | Good | 391 | 3.4 | 370 | 13.4 | Excellent | |
| Invention example 15 | Good | 380 | 4.9 | 365 | 18.2 | Good | |
| Invention example 16 | Excellent | 383 | 2.1 | 362 | 14.1 | Excellent | |
| Invention example 17 | Excellent | 374 | 1.5 | 356 | 14.9 | Excellent | |
| Invention example 18 | Excellent | 385 | 1.8 | 362 | 15.2 | Excellent | |
| Comparative example 22 | | | | | | | Casting was impossible. |
| Comparative example 23 | | | | | | | Casting was impossible. |
| Comparative example 24 | Good | 335 | 3.3 | 321 | 18.8 | Good | |
| Comparative example 25 | | | | | | | Casting was impossible. |
| Comparative example 26 | Good | 339 | 3.8 | 317 | 16.7 | Poor | |
| Comparative example 27 | Good | 365 | 4.5 | 344 | 8.5 | Poor | |
| Comparative example 28 | Excellent | 374 | 2.2 | 351 | 9.0 | Good | |
| Comparative example 29 | Poor | 338 | 8.7 | 316 | 7.7 | Poor | |
| Comparative example 30 | Good | 360 | 5.5 | 337 | 9.7 | Poor | |
| Comparative example 31 | Poor | 340 | 6.7 | 316 | 16.9 | Good | |
| Comparative example 32 | Poor | 322 | 11.3 | 297 | 17.6 | Poor | |
| Comparative example 33 | Poor | 334 | 8.2 | 314 | 17.8 | Poor | |
| Comparative example 34 | | | | | | | Forging crack |
| Comparative example 35 | Poor | 336 | 9.4 | 311 | 17.8 | Excellent | |
| Comparative example 36 | Poor | 338 | 13.6 | 315 | 16.4 | Good | |
| Comparative example 37 | | | | | | | Forging crack |
| Comparative example 38 | Good | 355 | 4.0 | 322 | 21.4 | Poor | |
| Comparative example 39 | Poor | 339 | 14.6 | 305 | 6.2 | Poor | |
| Comparative example 40 | Poor | 331 | 8.0 | 317 | 17.9 | Poor | |
| Comparative example 41 | Excellent | 324 | 2.4 | 303 | 18.0 | Excellent | |
| Comparative example 42 | Excellent | 359 | 1.9 | 327 | 19.6 | Poor | |
| Comparative example 43 | Excellent | 339 | 2.1 | 334 | 9.1 | Excellent | |
| Comparative example 44 | Excellent | 338 | 2.0 | 309 | 22.1 | Poor | |
| Comparative example 45 | Excellent | 338 | 2.3 | 310 | 11.0 | Excellent | |

As shown in Table 3 and Table 4, the Al alloy forged materials using the manufacturing condition satisfying the stipulation of the claim 4 of the present invention (invention examples 12-18) were less in variation of the tensile strength, and were excellent in tensile strength, 0.2% proof stress, elongation, and stress corrosion cracking resistance. On the other hand, with respect to the Al alloy forged materials using the manufacturing condition not satisfying the stipulation of the present invention, casting or forging could not be executed in comparative examples 22, 23, 25, 34 and 37, and comparative examples 24, 26-33, 35-36, 38-45 were inferior in any one or more out of the tensile strength, 0.2% proof stress, elongation, and stress corrosion cracking resistance. In Table 3, the manufacturing condition not satisfying the stipulation of the present invention was shown by drawing an underline under the figure.

When the invention example 13 and the invention example 14 are compared to each other, the invention example 14 has a higher value in the tensile strength. However, the process capability of ±4σ (the range in which 99.9937% is included) becomes;

386±4×1.5=380-392 MPa Invention example 13:

391±4×3.4=377.4-404.6 MPa, Invention example 14:

and it is known that high strength material has been obtained more stably in the invention example 13. Accordingly, as the figure on the process capability, that of the invention example 13 is more advantageous figure. This is considered to be due to the fact that the depth of recrystallization is 1 mm or more in the invention example 14, whereas the depth of recrystallization is less than 1 mm and variation in the tensile strength is less in the invention example 13.

What is claimed is:

1. An aluminum alloy forged material, comprising:

Si: 0.7-1.5 mass %;

Fe: 0.1-0.5 mass %;

Mg: 0.6-1.2 mass %;

Ti: 0.01-0.1 mass %;

Mn: 0.3-1.0 mass %;

at least one element selected from the group consisting of Cr: 0.1-0.4 mass % and Zr: 0.01-0.2 mass %;

Cu: 0.1 mass % or less;

Zn: 0.05 mass % or less;

a hydrogen amount: 0.25 ml/100 g-Al or less; and

Al, wherein a depth of recrystallization does not exceed 5 mm from the aluminum alloy forged material's surface.

2. The aluminum alloy forged material according to claim 1, comprising:

Si: 1.0-1.3 mass %;

Fe: 0.2-0.4 mass %;

Mg: 0.7-1.1 mass %;

Ti: 0.01-0.08 mass %;

Mn: 0.5-0.9 mass %;

at least one element selected from Cr: 0.1-0.3 mass % and Zr: 0.05-0.2 mass %; Cu: 0.1 mass % or less; and Zn: 0.05 mass % or less.

3. The aluminum alloy forged material according to claim 1 or claim 2, wherein the depth of recrystallization from the aluminum alloy forged material's surface is less than 1 mm.

4. A method for manufacturing the aluminum alloy forged material according to claim 1, the method comprising:

(i) casting an ingot of the aluminum alloy at a heating temperature of 700-780° C. and a casting rate of 200-400 mm/min;

(ii) subjecting the ingot to temperature-raising at a rate of 0.5° C/min or more and less than 10° C/min, to homogenizing heat treat treatment at 480-560° C. for 2-12 hours, and to cooling to 30020 C. or below at a rate of 1.0° C/min or more;

(iii) subjecting the ingot to heating at 500-560° C. for 0.75-6 hours after said subjecting (ii);

(iv) subjecting the ingot to forging at a forging start temperature of 450-560° C. and a forging finish temperature of 360° C. or above to obtain a forged material of a predetermined shape;

(v) subjecting the forged material to solution heat treatment at 500-560° C. for more than 0 hour and 24 hours or less;

(vi) subjecting the forged material to quenching at 75° C. or below after said subjecting (v) to obtain a quenched forged material; and (vii) subjecting the quenched forged material to artificial aging treatment at 140-200° C. for 1-24 hours.

5. The method according to claim 4, further comprising:

(viii) subjecting the ingot to pre-forming after said subjecting (iii) and before said subjecting (iv).

6. The method according to claim 4 or claim 5, further comprising:

(ix) subjecting the ingot to extrusion working after said subjecting (ii) and before said subjecting (iii).

7. The aluminum alloy forged material according to claim 1, which has an average tensile strength of 340 MPa or more and a variation in tensile strength of 6.0 or less.

* * * * *